US008477156B2

(12) United States Patent
Sarrasin

(10) Patent No.: US 8,477,156 B2
(45) Date of Patent: Jul. 2, 2013

(54) METHOD OF DRIVING A MATRIX DISPLAY DEVICE HAVING AN ELECTRON SOURCE WITH REDUCED CAPACITIVE CONSUMPTION

(75) Inventor: Denis Sarrasin, Sassenage (FR)

(73) Assignee: Commissariat a l'Energie Atomique, Paris (FR)

( * ) Notice: Subject to any disclaimer, the term of this patent is extended or adjusted under 35 U.S.C. 154(b) by 759 days.

(21) Appl. No.: 12/444,396

(22) PCT Filed: Oct. 26, 2007

(86) PCT No.: PCT/EP2007/061560

§ 371 (c)(1),
(2), (4) Date: Apr. 6, 2009

(87) PCT Pub. No.: WO2008/052945

PCT Pub. Date: May 8, 2008

(65) Prior Publication Data

US 2010/0013865 A1 Jan. 21, 2010

(30) Foreign Application Priority Data

Oct. 30, 2006 (FR) ..... 06 54624

(51) Int. Cl.
*G09G 5/10* (2006.01)

(52) U.S. Cl.
USPC ..... 345/690; 345/213; 345/89

(58) Field of Classification Search
USPC ..... 345/690, 213, 89
See application file for complete search history.

(56) References Cited

U.S. PATENT DOCUMENTS

| | | | |
|---|---|---|---|
| 4,940,916 | A | 7/1990 | Borel et al. |
| 5,555,000 | A | 9/1996 | Sarrasin et al. |
| 6,300,922 | B1 | 10/2001 | Teggatz |
| 6,862,010 | B2 | 3/2005 | Nicolas et al. |
| 2006/0139250 | A1 | 6/2006 | Sarrasin |

FOREIGN PATENT DOCUMENTS

| | | | |
|---|---|---|---|
| EP | 0 597 772 | A1 | 5/1994 |
| EP | 0 635 819 | A1 | 1/1995 |
| EP | 0 316 214 | B1 | 1/1998 |
| EP | 1 677 277 | A2 | 7/2006 |
| FR | 2 832 537 | A1 | 5/2003 |
| WO | WO 2007/122122 | A1 | 11/2007 |

OTHER PUBLICATIONS

R. Baptist, "Ecrans fluorescents à micropointes" L'Onde Électrique, vol. 71, No. 6, Nov.-Dec. 1991, pp. 36-42.

(Continued)

*Primary Examiner* — Alexander Eisen
*Assistant Examiner* — Robin Mishler
(74) *Attorney, Agent, or Firm* — Oblon, Spivak, McClelland, Maier & Neustadt, L.L.P.

(57) ABSTRACT

A method to drive a display device with electron sources displaying grey scales divided into two families. The display device includes one or more rows and one or more columns. An intermediate potential lies between a first potential and a second potential. To display a grey level of the first family, the column voltage is pulse width modulated between the intermediate potential and the second potential right at the start of the row selection period. To display a grey level of the second family, the column voltage is pulse width modulated between the intermediate potential and the first potential from a determined instant of the row selection period.

16 Claims, 6 Drawing Sheets

OTHER PUBLICATIONS

S. Uemura, et al. "Cardon Nanotube FED Elements" SID 98 Digest, 1998, pp. 1052-1055.

T. Leroux, et al. "Microtips Displays Addressing" SID 91 Digest, 1991, pp. 437-439.

J. Dijon, et al. "6-in. Video CNT-FED with Improved Uniformity" FED1-1, IDW/AD '05, The Society for Information Display, pp. 1635-1638, and 7 additional pages.

K. Sakai, et al. "Flat Panel Displays Based on Surface-conduction Electron Emitters" Euro Display 1996, pp. 569-572.

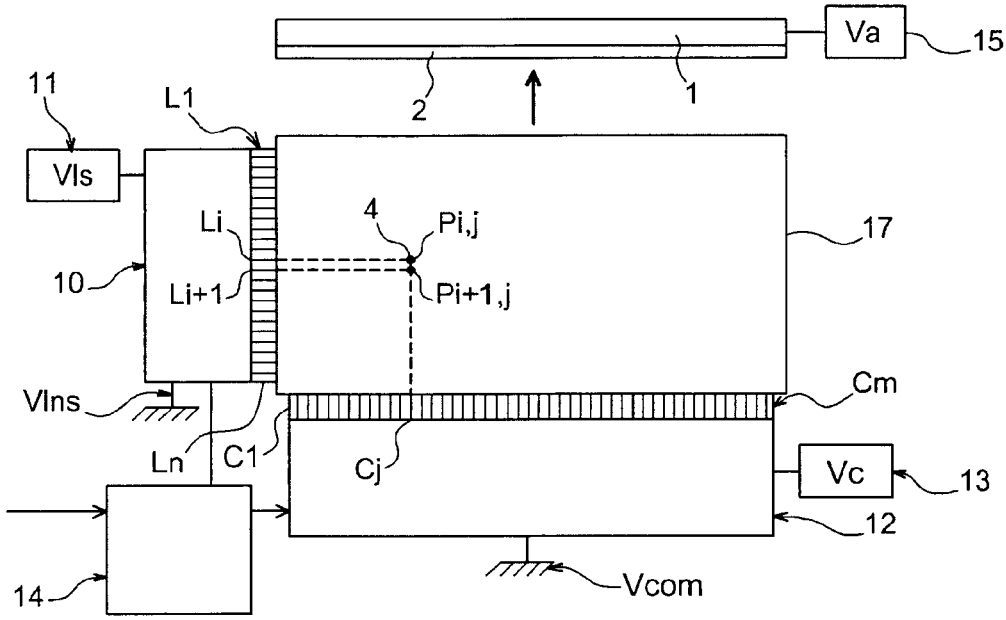
FIG. 3
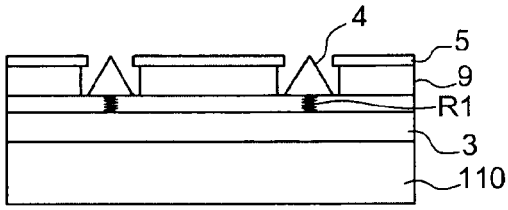
FIG. 4
FIG. 5
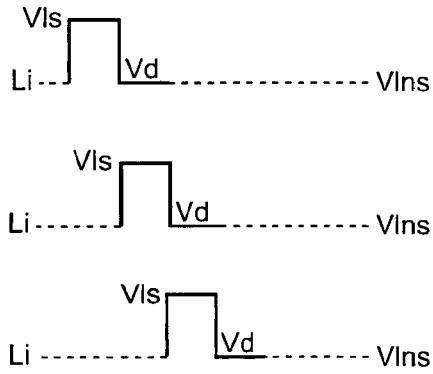

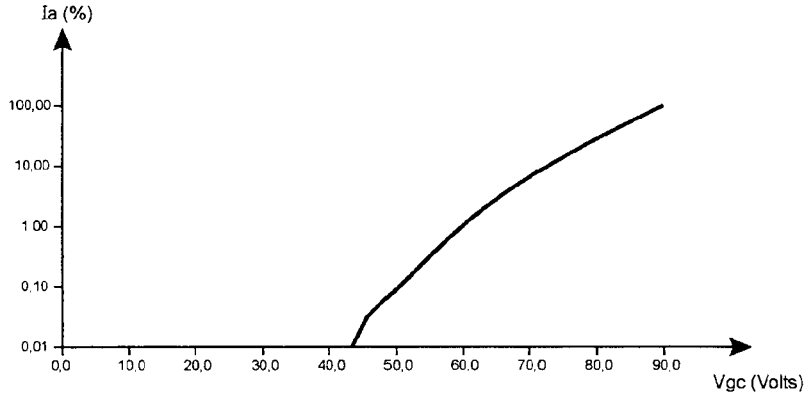
FIG. 6
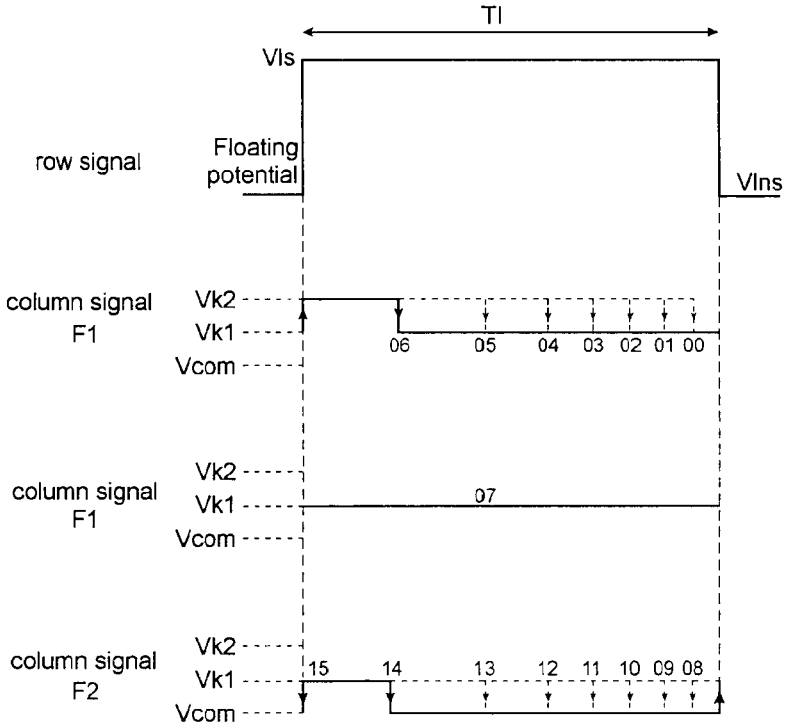
FIG. 7A
FIG. 7B
FIG. 7C
FIG. 7D

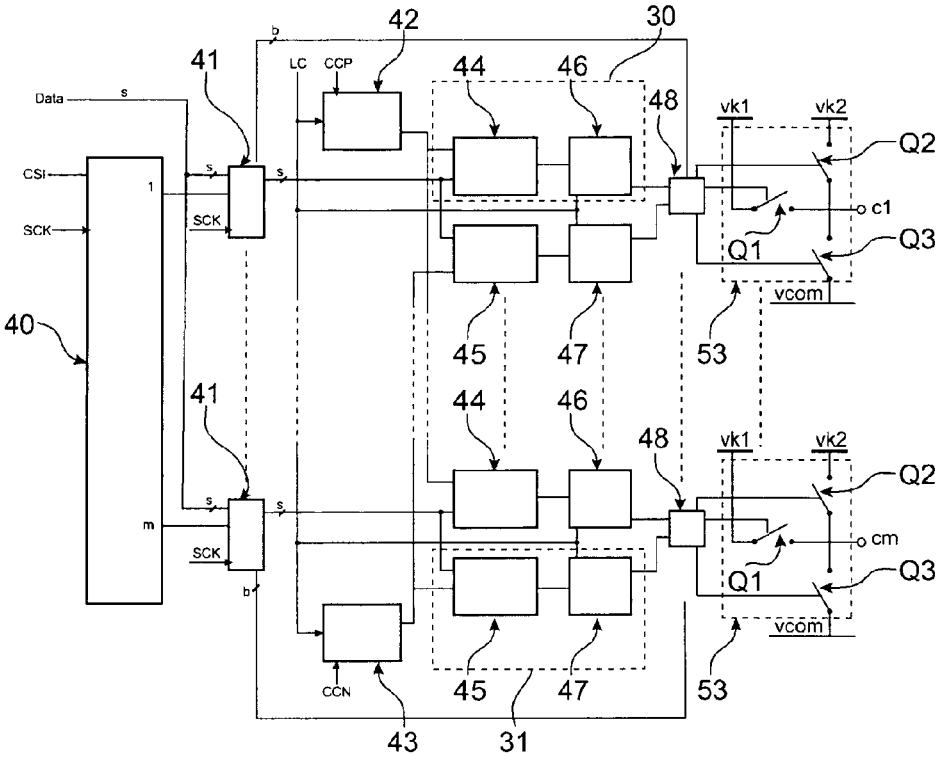
FIG. 8B
FIG. 8C
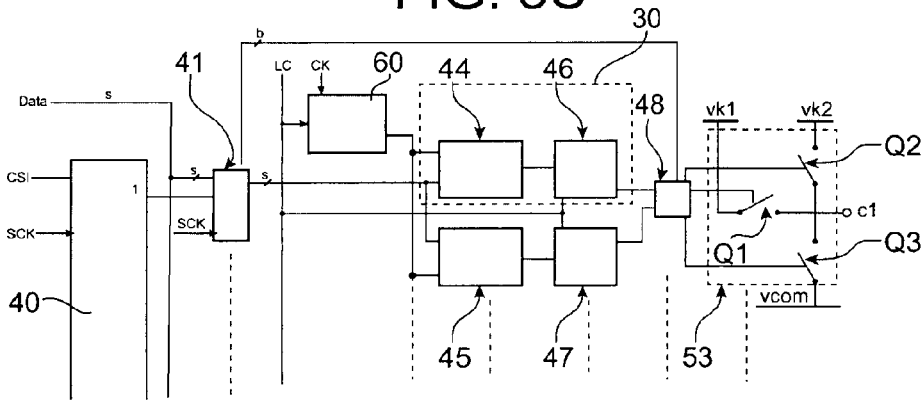

METHOD OF DRIVING A MATRIX DISPLAY DEVICE HAVING AN ELECTRON SOURCE WITH REDUCED CAPACITIVE CONSUMPTION

TECHNICAL FIELD

The present invention concerns a method to drive a matrix display device provided with one or more electron sources, capable of displaying images having different grey scales. The images to be displayed may be in black or white or in colour, in this latter case the expression <<grey scale>> meaning half-tone colour. Black and white are included in the grey scales.

STATE OF THE PRIOR ART

Display devices with electron sources find applications in the area of flat panel displays. Various types of these display devices exist depending on the type of their electron sources. For example field effect microdot cathodes are known as described in document [1], field effect nanogap sources as described in the document referenced [2], planar electron sources of graphite or diamond carbon type as described in the document referenced [3]. The references of these four documents can be found at the end of the description.

FIG. 1 schematically illustrates the operating principle of an exemplary field emission display device with electron sources, to which the method of the invention can be applied.

The display device comprises electron sources 100 comprising anode electrodes 1 coated with a luminescent phosphor material 2, cathode electrodes 3 electrically connected to electron emitting regions 4, gate electrodes 5 electrically insulated from the cathode electrodes 2. Each emitting region 4 is associated with a gate electrode 5. There is a vacuum 6 between the emitting regions 4 and the phosphor material 2. The device for driving the electron sources 100 comprises a voltage source 7 and biasing means 8. The voltage source 7 is used to apply a high potential Va to the anode electrodes 1. The biasing means 8 are used, for a given electron source 100, to apply a potential Vg to the gate electrode associated with it, and a potential Vc1, Vc2, Vc3 to the cathode electrode 3 to which it is connected. The difference in potential Vgc1, Vgc2, Vgc3, generally designated as Vgc in the remainder of the description, represents the driving voltage of electron emission.

An electron source 100 emits a flow of electrons (not shown) from its emitting region 4 and this flow of electrons is collected by an anode electrode 1 lying opposite the emitting region when the difference in potential Vgc exceeds a threshold value Vthl. This flow of electrons is accelerated by means of the high potential Va applied to the anode electrodes 1. The phosphor material 2 emits light under the effect of the kinetic energy of the electrons with which it is bombarded. FIG. 2A shows an emission characteristic Ia=f(Vgc) of an electron source 4.

The display device can have a display panel 17 with matrix arrangement as illustrated FIG. 3 with several electron sources 4. Each electron source 4 represents a pixel Pi,j of the display panel. Each pixel Pi,j can be addressed and its luminance adjusted as described in the document referenced [4] whose complete references are given at the end of the description.

Each pixel Pi,j is defined as the intersection between an electrode of row L1, . . . Li, . . . . Ln and an electrode of column C1, . . . Cj, Cm of the display device 17. There are generally several row electrodes and several column electrodes. The row electrodes L1, . . . Li, . . . . Ln are generally connected to the gate electrodes and the column electrodes C1, . . . Cj, . . . Cm to the cathode electrodes. It is to be noted however that the display device 17 can be reduced to one electron source or one pixel if there is only one row electrode and only one column electrode to function in accordance with the method of the invention.

A driving device is provided to drive the display device with a line scan generator 10 connected to a voltage source 11 delivering a potential Vls and to an imposed reference potential Vlns, generally ground, enabling it to apply to the row electrodes either the row select potential Vls, or the reference potential Vlns or row non-select potential.

The driving device further comprises a column driving circuit 12 connected to a voltage source 13 delivering a potential Vcj and to a reference potential Vcom which may be ground. The line scan generator 10 and the column driving circuit 12 are connected to a display controller 14 which receives signals from an image data source (not shown), and control and synchronization signals and which delivers signals able to drive the line scan generator 10 and the column driving circuit 12. Regarding the anode electrodes 1, these are connected to a voltage source 15 delivering a potential Va.

More precisely, the line scan generator comprises a drive circuit for each row electrode. Similarly, the column drive circuit comprises a sub-circuit for each column electrode. Conventionally display panel driving is conducted as follows: the row electrodes L1, Ln can be driven sequentially each in turn during a row selection period Tl. A driven row electrode is brought to potential Vls and a non-driven row electrode is brought to potential Vlns. The pixels of a driven row electrode Li must each display a given information, and each column electrode Cj is brought to an appropriate potential Vcj. The potentials applied to the column electrodes do not affect the pixels of the non-driven row electrodes L1, Li−1, Li+1, Ln. It is also possible to cause the potential of a non-selected row electrode to float. Once the column electrode is no longer selected, it is discharged and set at high impedance.

To obtain grey scales, it is possible to act on the value of the differences Vls−Vcj and/or on the application time of the potential Vcj, or even on the quantity of charges supplied to the column electrodes and corresponding to the information to be displayed.

Therefore there are several methods to drive columns in display devices displaying grey scales.

Pulse width modulation (PWM) control consists of switching the reference potential of a column electrode Vcom to a fixed potential Vc for a variable time in relation to the grey level to be displayed, this variable time being equal to or less than the row selection period Tl.

Pulse width modulation control maximizes switching between potential Vc and the reference potential Vcom, which causes extensive capacitive consumption when driving a column. On each row selection, there is effectively strong row-column capacitance: this capacitance can be charged or discharged at the column electrode drive potential. On the other hand, this pulse width modulation control remains the simplest with respect to fabrication of the column drive circuit. Reference can be made to FIG. 2B, to be associated with FIG. 2A, in which several timing diagrams show the voltage to be applied to a selected row electrode and simultaneously to a column electrode whose corresponding electron source must display a dark grey or light grey. To display a light grey, the potential Vc is applied for shorter time than for the display of a dark grey.

This method comes up against the problem of capacitive consumption generated both by the potentials to be switched and by the frequency of such switching as already mentioned.

Pulse width modulation control is performed by applying to the column electrodes a potential whose value depends upon the grey scale to be displayed, applied throughout the entire row selection period Tl.

In display devices with mixed display drives, one or more potentials are applied successively to the column electrodes during the row selection period. The document referenced [5] describes said drive method, its references being given at the end of this description.

The charge driving method described in the document referenced [6] for example, whose complete references are given at the end of this description, sets out to supply the column electrodes with a quantity of charges corresponding to the grey scale to be displayed.

Also patent [7] describes the driving of row electrodes in which, after a first row selection period Tl and during a second row selection period, a discharge potential is applied to the row electrode which had been selected during the first row selection period, for at least during part of the second row selection period, and it is then left in high impedance state for as long as it is not re-selected. The row non-select potential is therefore a floating potential and depends upon the proportion of emitting electron sources on the selected row electrode.

DESCRIPTION OF THE INVENTION

The objective of the present invention is precisely to propose a method to drive a matrix display device with electron source, which reduces the capacitive consumption of the pulse width modulation mode.

A further objective is to secure uniformity of the response of the electron sources whilst avoiding the use of voltages close to those which block emission as is the case with pulse width modulation control.

To achieve these objectives, the invention more particularly concerns a method to drive a matrix display device with electron source, which uses pulse width modulation control to drive the column electrodes with three different potentials, one being intermediate between a first and a second potential, this first potential and this second potential conventionally being respectively used for blocking of emission and for emission, this intermediate potential to be associated with the first or with the second potential to display grey scales depending on whether they are considered as belonging to a first grey scale family corresponding to darkest grey levels, or to a second grey scale family corresponding to the least dark grey levels.

More precisely, the present invention proposes a method to drive a matrix display device able to display grey scales at one or more electron sources, comprising one or more row electrodes and one or more column electrodes, the electron source being defined at the intersection of a row electrode and a column electrode. In this method, during a row selection period, a row select potential is applied to a selected row electrode; simultaneously during said period a voltage is applied to a column electrode, this voltage depending on the grey level to be displayed by the electron source at the intersection of this selected row electrode and this column electrode. The grey levels to be displayed are divided into two grey scale families, the first grouping together one or more darkest grey levels, the second grouping together one or more of the least dark grey levels. If the grey level to be displayed by the electron source belongs to the first family, the voltage of the column electrode, right at the start of the row selection period, is brought from an intermediate potential, lying between a second potential used to display black and a first potential used to display white, to the second potential and it is then returned to the intermediate potential after a time equal to or less than the row selection period dependent upon the grey level to be displayed. If the grey level to be displayed belongs to the second family, the voltage of the column electrode is brought from the intermediate potential to the first potential at an instant of the row selection period which depends upon the grey level to be displayed, and it is returned to the intermediate potential at the end of the row selection period.

Additionally and advantageously, at the end of the row selection period, it is possible to bring the row electrode which was selected to a discharge potential, and it is then set at high impedance. This driving method is therefore associated with the principle of floating non-selected row electrodes.

It is also possible, for one of the grey levels of one of the families, to hold the voltage of the column electrode at the intermediate potential throughout the entire row selection period. In this case an additional grey level is provided.

The row select voltage may be constant throughout the row selection period.

When there are several electron sources on one same row electrode, a voltage is applied simultaneously to each of the column electrodes.

The first potential may simply be substantially 0 volt.

The intermediate potential may lie substantially midway between the first potential and the second potential.

The second potential is positive compared with the first potential.

The application times of the first potential during the row selection period and the application times of the second potential during the row selection period are advantageously distributed non-linearly to optimize perception of the display by the human eye.

For this purpose, the application times of the first potential or second potential may verify the equation $ti=Tl[1-(i/r)^{2,2}]$ in which r is the number of grey levels in the grey scale family for which switching occurs and i is a variant from 1 to r.

The present invention also concerns a device to drive a matrix display device displaying grey scales and comprising one or more electron sources each located at the intersection of a row electrode and a column electrode of an assembly comprising one or more row electrodes and one or more column electrodes. The device comprises a line scan generator which, when the row electrode on which the electron source lies is selected, applies a row select potential during a row selection period, and a column driving circuit able to apply to the corresponding column electrode a voltage corresponding to the grey level to be displayed, during the row selection period. The column driving circuit, for each column electrode of the assembly, comprises a first processing chain to deliver a pulse width modulated driving voltage, the pulse starting at the start of the row selection period, between an intermediate potential and a second potential used to display black, to be applied to the column electrode if the grey level belongs to a first grey scale family containing one or more darkest grey levels, and a second processing chain to deliver a pulse width modulated driving voltage, the pulse ending at the end of the row selection period, between the intermediate potential and a first potential, to be applied to the column electrode if the grey level belongs to a second grey scale family containing one or more least dark grey levels.

The line-scan generator, at the end of the row selection period, can advantageously bring the row electrode which was selected, but is no longer selected, to a discharge potential and then set it at high impedance.

The first processing chain, from information it receives encoding the grey level to be displayed, delivers a signal which translates an end-of-pulse instant of the pulse width modulated voltage in the row selection period. The second processing chain delivers a signal which translates a start-of-pulse instant of the pulse width modulated voltage in the row selection period, these processing chains being connected via selecting means to an output stage capable of delivering the voltage to be applied to the column electrode.

The first processing chain may comprise a comparator comparing the information encoding the grey level and the result of counting performed by a cyclic counter counting a number of clock pulses determined by the size of the data item encoding the grey level, during the row selection period, and a bistable latch connected to the output of the comparator and also receiving a pulse at the start of each row selection period and delivering the signal translating the end-of-pulse instant of the pulse width modulated voltage.

The second processing chain may comprise a comparator comparing the information encoding the grey level and the result of counting performed a cyclic counter counting a number of clock pulses determined by the size of the data item encoding the grey level, during the row selection period, and a bistable latch connected to the output of the comparator and also receiving a pulse at the end of each row selection period and delivering the signal translating the start-of-pulse instant of the pulse width modulated voltage.

The cyclic counter may be common to the first and second processing chain.

Since the grey level to be displayed is encoded in the form of a binary word with one or more most significant bits, the selecting means can be combinatorial logic circuits receiving one or more most significant bits of the binary word.

The column driving circuit may additionally comprise a shift register which supplies as many sets of latches as column electrodes, each set of latches at its input receiving the grey levels to be displayed by the display device and being connected to a first processing chain and to a second processing chain.

BRIEF DESCRIPTION OF THE DRAWINGS

The present invention will be better understood on reading the description of examples of embodiment given solely by way of indication and being in no way limiting, with reference to the appended drawings in which:

FIG. 3 (already described) illustrates a display device equipped with its conventional driving device;

FIG. 4 illustrates electron sources provided with a layer of resistive material coating their cathode electrodes;

FIG. 5 illustrates the different signals to be applied to the row electrodes when using a floating potential for a non-selected row electrode;

FIG. 6 illustrates the current response of the electron sources in FIG. 1;

FIG. 7A shows the signal to be applied to a row electrode in the method of the invention, FIG. 7B shows the signals to be applied to a row electrode to display grey levels encoded 00 to 06 in the first family F1, FIG. 7C shows the signals to be applied to a row electrode to display the grey level encoded 07 which is assumed to belong to the first family, and FIG. 7D shows the signals to be applied to a row electrode to display the grey levels encoded 08 to 15 in the second family F2 using the method of the invention;

FIG. 8B illustrates an exemplary column electrode driving device for the display device of the invention, and FIG. 8C partially illustrates another exemplary column electrode driving device for the display device of the invention.

Identical, similar or equivalent parts in the different figures carry the same reference numbers to facilitate cross-reading between the figures.

The different parts shown in the figures are not necessary drawn to scale for better legibility of the figures.

DETAILED DESCRIPTION OF PARTICULAR EMBODIMENTS

Figure 1:
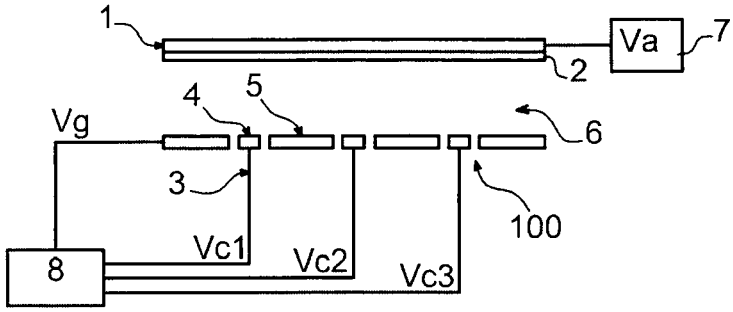
FIG. 1 (already described) illustrates a field emission display device with electron sources, to which the method of the invention can be applied.
Figure 2A:
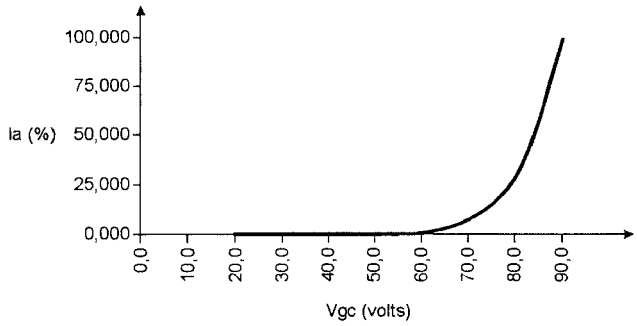
FIG. 2A (already described) is a graph showing the emission characteristics Ia=f(Vgc) of an electron source.
Figure 2B:
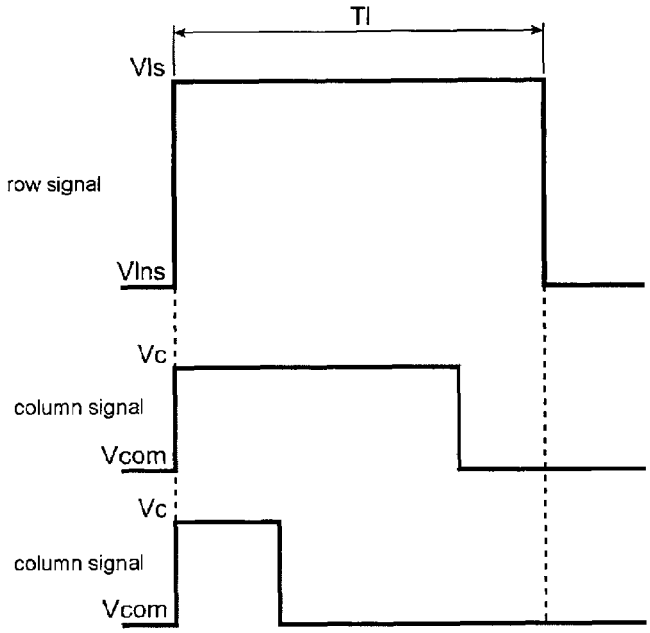
FIG. 2B (already described) illustrates the voltages to be applied to a selected row electrode, to a column electrode to display a dark grey, and to a column electrode to display a light grey, using conventional pulse width modulated control.
Figure 2C:
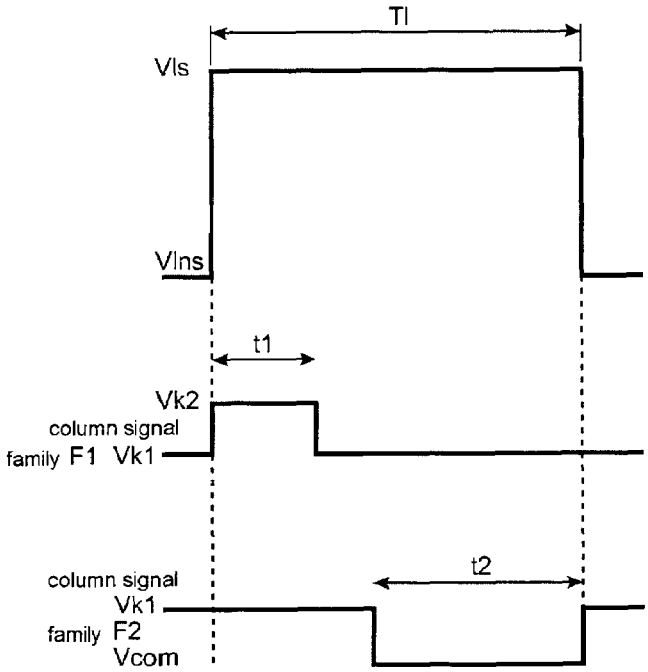
FIG. 2C illustrates the voltages to be applied to a selected row electrode, to a column electrode to display a dark grey (family F1) and to a column electrode to display a light grey (family F2) using the method of the invention.

Turning now to the timing diagram shown FIG. 2C, to be read with reference to the graph in FIG. 2A.

In the method of the invention, it is assumed that it is possible to display $2^n+1$ grey levels (n integer equal to or higher than one), these grey levels being encoded 0 to $2^n$. Code 0 corresponds to black and code $2^n$ to white. In practice, to simplify the associated electronics, advantageously only $2^n$ grey levels are used coded between 0 and $2^n-1$, either without using the level corresponding to black or without using the level corresponding to white.

The $2^n+1$ grey levels can arbitrarily be divided into two grey scale families, namely a first family F1 of the darkest grey levels and a second family F2 of the least dark grey levels. The first family F1 comprises p grey levels (p an integer strictly lower than $2^n+1$), these p grey levels being coded between 0 (black) and p−1. Level p−1 corresponds to the lightest grey level of the first family F1 of darkest grey levels. The second grey scale family F2 comprises $2^n-p$ grey levels coded between level p and level $2^n$ (white). Level p corresponds to the darkest grey level of the second family F2 of the lightest grey levels. The graph in FIG. 2C shows the voltages to be applied to a selected row electrode and to a column electrode so that the electron source at the intersection of this row electrode and this column electrode respectively displays a dark grey of the first family F1 and a light grey of the second family F2 using a driving method conforming to the invention.

In FIG. 2C, the voltage to be applied to a selected row electrode is identical to that shown FIG. 2B. On the other hand, advantageously, at the start of a second row selection period Tl following after the first period during which the row electrode was selected, the row electrode which is now no longer selected is brought to a discharge potential Vd for at least part of the second row selection period, then it is set at high impedance outside the first row selection period and the part of the second row selection period as described in patent [7].

This means that the row non-select potential Vlns is a floating potential. Reference can be made to FIG. 5 which illustrates this functioning for several row electrodes Li to Li+2. The discharge potential Vd is equal to or less than Vk2 which is the potential for display of white. The row non-select potential Vlns is shown as a dotted line to indicate that it is floating.

This characteristic which consists of leaving the potential to float is evidently not compulsory. The driving of the row electrode potentials can be performed conventionally using the imposed potentials Vls and Vlns.

Regarding the voltage to be applied to a column electrode, a pulse width modulation will be used with three potentials instead of two as is conventional. Among these three potentials, a distinction can be made between a first potential Vcom or reference potential used to display white, a second potential Vk2 used to display black, and an intermediate potential Vk1. The second potential Vk2 is positive relative to potential Vcom. Potential Vcom is preferably ground. The second potential Vk2 blocks the emission of electrons at the electron source.

To display a dark grey i.e. belonging to the first grey scale family F1, the potential of the column electrode under consideration is brought from the intermediate potential Vk1 to the second potential Vk2 at the start of the row selection period Tl, this second potential is maintained for a variable time t1 which depends upon the grey level to be displayed, and the potential is brought back to the intermediate potential Vk1 before the end of the row selection period Tl or at the end of the row selection period Tl. The longer the time t1, the darker the grey level. If it is black which must displayed, then time t1 is equal to Tl or close to Tl. In this latter case, the level truly corresponding to black was excluded from the encoding into $2^n$ grey levels. There are therefore $2^n-p$ different times t1 for application of the potential Vk2 corresponding to the p darkest grey levels.

To display a light grey level i.e. belonging to the second grey scale family F2, the potential of the column electrode under consideration is brought from the intermediate potential Vk1 to the first potential Vcom, and this first potential Vcom is maintained for a time t2 which ends at the end of the row selection period Tl, and it is then brought back to the intermediate potential. If it is white which must be displayed, time t2 is equal to the row selection period Tl. The shorter the time t2, the darker the displayed grey from the second family F2 of least dark greys. There are therefore $2^n-p$ different application times t2 for the first potential Vcom, corresponding to the n−p lightest grey levels.

Triggering to the second potential Vk2 for the grey levels in the first family F1 is made immediately at the start of the row selection period Tl, and triggering to the intermediate potential Vk1 occurs at a second stage at the end of time t1. Triggering to the intermediate potential Vk1 from the first potential for the light grey levels is made at the end of the row selection period Tl, and triggering from the intermediate potential Vk1 to the first potential Vcom occurs before the end of the row selection period Tl or at the end of the row selection period Tl. The start triggering edges for the grey levels of the first family F1 and the end triggering edges for the grey levels of the second family F2, are therefore always in phase, which allows the potential of the rows left to float to follow these edges and hence to cancel out corresponding capacitive consumption.

Only one of the two grey scale families F1 or F2 comprises a grey level obtained by maintaining the intermediate potential Vk1 throughout the entire row selection period Tl as illustrated FIG. 7C.

If this grey level is assigned to the family F2 of least dark grey levels, the start and end pulses merge, there is no switching to potential Vcom.

If this grey level is assigned to the family F1 of darkest greys, the start pulse occurs at the end of the row period Tl, and the signal remains at potential Vk1.

Functioning based on pulse width modulation, between three potentials, for the column electrodes leads to a significant reduction in the capacitive consumption of the column electrodes, compared with conventional pulse width modulation. This capacitive reduction is further increased if the electrodes of non-selected rows are brought to a floating potential.

In the method of the invention, three potentials are used for pulse width modulation which allows substantially only half of the voltage swing to be switched during a row selection period Tl. Capacitive consumption is thereby limited by a factor of four, since this capacitive consumption varies as the square of the voltage.

Utilization of pulse width modulation control also meets the need to secure uniformity of the response of the electron sources. With display devices a problem is effectively encountered in that the electron sources are not uniform in terms of emission, some performing highly and emitting more than others for one same driving voltage. This translates at the luminescent phosphor material, on the anode electrode side, as a scarcely homogeneous image dotted with bright spots. It is indicated in the document referenced [1] or in the document referenced [8], whose references are given at the end of the description, that one efficient means to homogenize emission consists of penalizing the best performing electron sources to bring their emission down to a lower level. This is generally achieved by placing a resistance R1 in series between each emitting region 4 and the cathode electrode 3 connected to it. A difference in potential proportional to the current passing through the electron source is then subtracted from the potential difference Vgc, which restricts the emission current. This resistance can materialize as a layer of resistive material coating the cathode electrodes. FIG. 4 illustrates said configuration. The gate electrodes 5 are insulated electrically from the cathode electrodes 3 by a layer of dielectric material 9. In FIG. 4, the cathode electrode 3 lies on an electrically insulating substrate 110. This resistance R1 is all the more efficient the greater the increase in the gate-cathode potential difference (or column electrode-row electrode) as mentioned in article [9] whose references are given at the end of the description. The method of the invention, by using either around one half (for the darkest grey family F1) or the same gate-cathode potential difference (for the family F2 of least dark greys) compared with a conventional pulse width modulated device, allows benefit to be drawn from the advantages of the resistive layer coating the cathode electrodes 3.

The current response of the electron sources, and hence the luminance response of the display device, is close to an exponential law as illustrated FIG. 6 whereas the response of the human eye to a light stimulus is not proportional to its intensity but follows a logarithmic curve. The human eye is more sensitive to differences in luminance under low lighting than under strong lighting. Its perception of luminance follows a non-linear, so-called gamma correction law which was modeled by the International Commission on Illumination in particular.

The response curve of the human eye is therefore a non-linear law fairly close to the inverse of the response curve of the electron source.

It is therefore preferable, in order to limit the number of grey levels to be encoded, to use an image data source having luminance values that are encoded non-linearly so that the number of grey levels in the first grey scale family F1 is equal to the number of grey levels in the second grey scale family F2, whilst maintaining a minimum voltage difference between the two families, which is the best compromise for capacitive consumption. It is evidently possible for the two families not to have the same number of grey levels. The excitation times for the different grey levels in either of the families will reproduce the non-linearity of encoding of the image data source.

One example of implementation of the method according to the invention will be described below with only 16 grey levels to simplify the graph given FIGS. 7A, 7B, 7C, 7D.

FIG. 7A shows the voltage applied to a row electrode which is selected during a row selection period Tl. This row electrode, prior to the start of the row selection period Tl, was at high impedance, it switches over to the row select potential Vls right at the start of the row selection period Tl. At the end of the row selection period Tl, it switches over to the row non-select potential Vls before returning to high impedance.

It is assumed that each of the families comprises 8 grey levels. The first family F1 comprises the grey levels coded from 00 (for black) to 07 (for medium grey). The second family F2 comprises the levels coded 08 to 15 (for white).

FIG. 7B shows the appearance of the potentials to be applied to the column electrodes to display a grey level of the first grey scale family F1 with the exception of the medium grey coded 07 which is shown FIG. 7C. It is assumed that the grey coded 07 belongs to the first grey scale family, but this grey coded 07 could just as well have belonged to the second grey scale family F2.

To display a grey of the first family F1, the potential of the column electrode under consideration, which is the intermediate potential Vk1, is brought, right at the start of the row selection period T1, to the second potential Vk2 used to display black, and this second potential Vk2 is maintained for a time t1 equal to or less than the row selection period Tl. Then the potential of the column electrode is returned to the intermediate potential Vk1 and, if necessary, the intermediate potential Vk1 is maintained for the remainder of the time of the row selection period Tl.

The solid line indicates the appearance of the voltage used to display the grey coded 06. The dotted lines show the appearance of the voltages used to display the greys coded 05 to 00.

If the medium grey 07 of the first family F1 is to be displayed, this is illustrated FIG. 7C. In this case, the intermediate potential Vk1 is maintained throughout the entire row selection period Tl.

To display a grey of the second family F2, as illustrated FIG. 7D, the potential of the corresponding column electrode, which is the intermediate potential Vk1, is brought to the reference potential Vcom, and this reference potential Vcom is maintained for a second time length t2 which ends at the end of the row selection period Tl. Switching to the first potential Vcom is made right at the start of the row selection period Tl, if white is to be displayed. The solid line shows the appearance of the voltage used to display the grey coded 14. The dotted lines show the appearance of the voltages used to display the greys coded 15 to 08 and in particular the instants of switchover from the intermediate potential Vk1 to the reference potential Vcom.

With the method of the invention, it is possible to display $2^n+1$ grey levels (i.e. 17 grey levels) if the first family F1 of greys integrates a grey level for which the potential of the column electrode is switched from the intermediate potential Vk1 to the second potential Vk2 right at the start of the row selection period Tl, then from the second potential Vk2 to the intermediate potential Vk1 at the end of the row selection period Tl as illustrated FIG. 7B.

In the example illustrated FIG. 7, the following could be chosen:

Vlns=0 V
Vls=90 V
Vcom=0 V
Vk1=20 V
Vk2=40 V.

An example will now be given of the calculation of two time lengths t1 and t2, if the gamma correction of a cathode ray tube is applied. It is assumed that the first family F1 comprises r grey levels and that the second family comprises q levels.

It is assumed that these figures r and q do not take into account an intermediate level for which the voltage remains constant at the level of the intermediate potential Vk1 throughout the entire row selection period Tl.

The application time $t1_i$ of the second potential Vk2 is expressed as:

$$t1_i = Tl \times [1-(i/r)^{2.2}] \text{ with } i \text{ being a variant from 1 to } r.$$

The application time $t2_j$ of the reference potential Vcom is expressed as:

$$t2_j = Tl \times [1-(j/q)^{2.2}] \text{ with } j \text{ being a variant from 1 to } q.$$

For a row selection period Tl of 64 microseconds and r=q=8 this would give time lengths $t1_i$ and $t2_j$ of: 0.66 microseconds, 3.03 microseconds, 7.4 microseconds, 13.9 microseconds, 22.76 microseconds, 33.96 microseconds, 47.71 microseconds and 64 microseconds.

The present invention also concerns a device to drive a matrix display panel with electron sources.

Figure 8A:
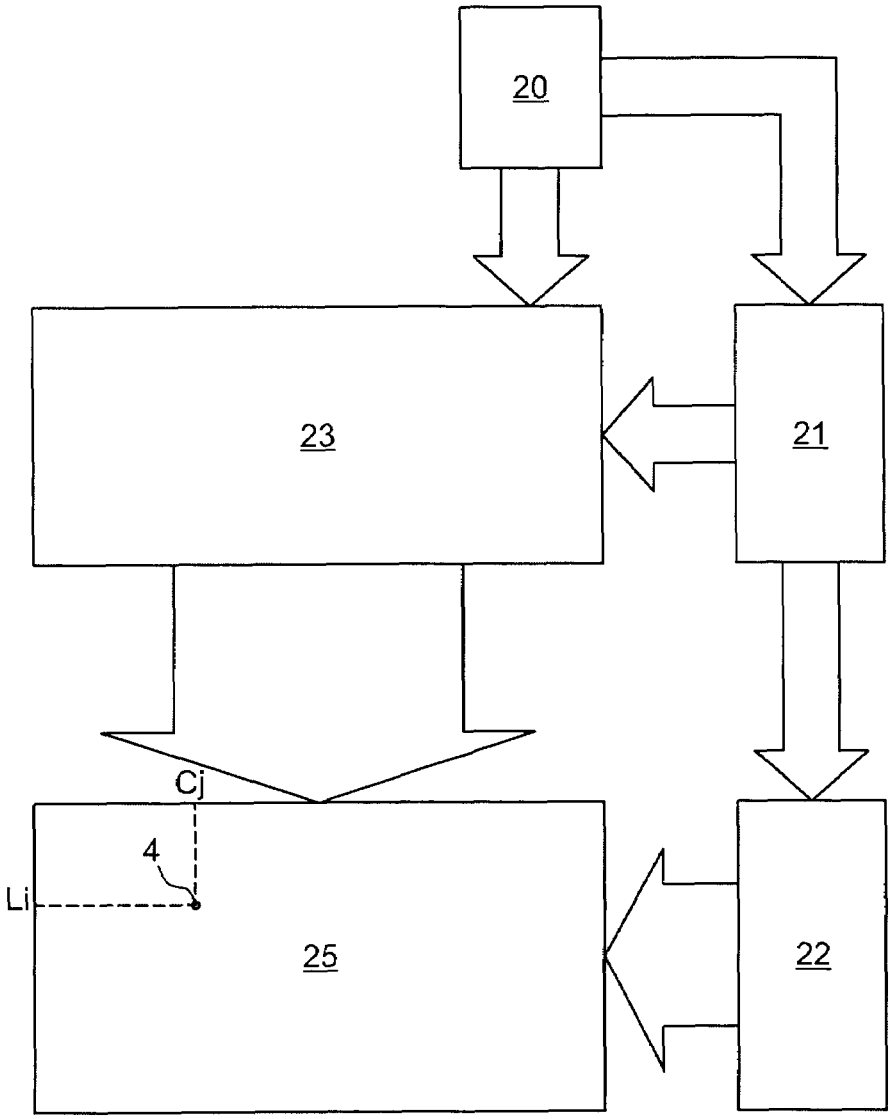
FIG. 8A illustrates the device to drive a display device according to the invention.

With reference to FIGS. 8A, 8B, 8C. FIG. 8A schematically illustrates the driving device for a matrix display device 25 with electron sources enabling grey scale display according to the method of the invention. The display device 25 comprises several electron sources Pi,j located at the intersection of a row electrode and a column electrode, this row electrode and this column electrode forming part of an assembly of one or more rows and one or more columns.

The electron source Pi,j materializes a pixel. The device to drive the display device comprises, as is conventional, a line scan generator to scan one or more rows 22 and a driving circuit to drive one or more columns 23. The circuit driving the columns 23 is connected to a digital data source 20 able to provide binary words encoding, over s bits, the grey level to be displayed by a pixel. The device to drive the display device also comprises a display controller 21.

The display controller 21 receives synchronization signals from the data source 20, it manages and provides signals able to drive the line scan generator 22 and column driver circuit 23.

The line scan generator 22 is not described in further detail, it does not give rise to any problem for the person skilled in the art who may refer for example to the one described in patent application [7] if a floating potential is used.

A detailed description will now be given of an example of embodiment of a column driving circuit with reference to FIG. 8B.

The column driving circuit comprises a shift register 40 acting as address decoder. This shift register 40 has m outputs and propagates m times the selection bit CSI by the clock signal SCK. The m outputs of the shift register 40 drive as many latches 41 as column electrodes c1 to cm, each thereof cooperating with one of the column electrodes c1 to cm of the display device 25 illustrated FIG. 8A. If the $2^n$ grey levels to be displayed are encoded by binary words of s bits with s equal to $2^n$, the sets 41 comprise s latches. These sets 41 of latches also receive Data binary words encoding the information to be displayed, delivered by the digital data source 20, which they memorize together with the clock signal SCK when the shift register 40 validates said set 41 of latches.

The output of each of the m sets 41 of latches supplies firstly a first processing chain 30 intended to deliver a voltage command signal to be applied to the associated column electrode when the voltage must switch at the start of the row selection period from the intermediate potential Vk1 to the second potential Vk2, which corresponds to a grey level to be displayed belonging to the first grey scale family F1, and secondly a second processing chain 31 intended to deliver a voltage command signal to be applied to the associated column electrode when the voltage must switch at the end of the row selection period from the first potential Vcom to the intermediate potential Vk1, which corresponds to a grey level to be displayed belonging to the second grey scale family F2. The outputs of these first and second processing chains 30, 31 are connected to a column electrode c1 to cm, which is the associated column electrode, via selecting means 48 to select the first processing chain 30 or the second processing chain 31.

The m first processing chains 30 each comprise a comparator 44 receiving firstly the s outputs of the sets 41 of latches and secondly the result of counting performed by a cyclic counter 42, clocked by a clock CCP and reset by a charge signal LC alerting to the start of each row selection period T1. The counter, during the row selection period T1, performs counting corresponding to the number of grey levels of the family F1 of darkest greys.

At the output of the comparators 44 there are m latches 46 triggering with the charge signal LC giving information on the start of a row selection period and the output of the associated comparator 44. The comparator 44 changes state when the binary value of the counter 42 reaches the binary value present at the outputs of the corresponding set 41 of latches. Therefore for an image data item belonging to the first grey scale family of F1, the assembly of the counter 42 and comparator 44 associated with the latch 46 can be used to adjust the time length t1.

The m second processing chains 31 each comprise a comparator 45 receiving firstly the s outputs of the sets 41 of latches and secondly the result of counting performed by a cyclic counter 43, clocked by a clock CCN and reset by a charge signal LC alerting to the end of each row selection period Tl. The counter 43, during the row selection period Tl, performs counting corresponding to the number of grey levels of the family F2 of least dark greys.

At the output of the comparators 45 of the second processing chains 31, there are m latches 47 triggering with the charge signal LC, indicating the end of a row selection period and the output of the associated comparator 45. The comparator 45 changes state when the binary value of the counter 43 reaches the binary value present at the output of the set 41 of corresponding latches. Therefore, for an image data item belonging to the second grey scale family F2, the counter 43 and comparator 45 associated with the latch 47 can be used to adjust the switch time from the intermediate potential Vk1 to the first potential Vcom. The charge signal LC indicates both the start of the row selection period and the end of the row selection period, the latter corresponding to the start of the selection period of the following row.

The output stage 53 comprises three switches Q1, Q2, Q3 star-mounted between a common point which corresponds to the associated column electrode c1 and respectively the intermediate potential Vk1, the second potential Vk2 and the first potential Vcom. These switches Q1, Q2, Q3 may be transistors and only one thereof may be in the On state at any one time. The switches Q1 and Q2 are push-pull mounted between the second potential Vk2 and the reference potential Vcom respectively. The m output stages 53 can switch selectively one of the three potentials Vk1, Vk2, Vcom via the command for each of the three switches Q1, Q2, Q3. The switch Q1 allows switching of the second potential Vk1 on the associated column electrode whilst switch Q2 allows the reference potential Vcom to be imposed.

The output stage 53, at its input, is connected to the outputs of the selecting means 48.

The selecting means 48 can be formed of combinatorial logic circuits which, in relation to one or more most significant bits b of the binary words encoding the information to be displayed, can be used to validate either the output of the first processing chain 30 at the output stage 53 i.e. to block the switch Q3 and to turn on switch Q2 and switch Q1 at instants appropriate for the grey level to be displayed, or to validate the output of the second processing chain 31 i.e. to block switch Q2 and turn on switch Q3 and switch Q1 at instants appropriate for the grey level to be displayed. The selecting means 48 receive these most significant bits b.

In each processing chain 30, 31, the comparator 44, 45 therefore changes state at a given instant which corresponds to the time at which the counting result of the cyclic counter 42, 43 coincides with the data present on the s first inputs of the comparator 44, 45. These bistable latches 46, 47 at their input also receive the charge signal LC which translates the start or the end of the row selection period. These bistable latches 46, 47 are triggered as soon as the signals arriving on their two inputs have changed. The output of the bistable latch 46 is connected to transistors Q1, Q2 of the output stage 53 at their control gate, via the selecting means 48. The output stage 53 is capable of switching in relation to the signal it receives from the bistable latches 46, 47, either the second potential Vk2 (transistor Q2 on and transistor Q3 blocked), or the first potential Vcom (transistor Q3 on and transistor Q2 blocked), or neither of these two potentials as per the validation delivered by the selecting means 48. In this last possibility, it is the third transistor Q1 of the output stage which is turned on and the two transistors Q2 and Q3 are blocked.

It is possible for the counter 42 associated with the first processing chains 30 and for the counter 43 associated with the second processing chains to be merged, which simplifies the circuit in FIG. 8B. This requires that the two clocks CCP and CCN also be merged. However, this variant limits the possibilities of adjusting the response curve of the grey levels. FIG. 8C schematically illustrates said configuration for the first and second processing chains associated with the column electrode c1. The common counter is referenced 60 and the clock CK.

Although several embodiments of the present invention have been described and illustrated in detail, it will be appreciated that different changes and modifications may be made thereto without departing from the scope of the invention.

CITED DOCUMENTS

[1] <<Ecrans fluorescents a micropointes>>, R. Baptist, l'Onde Electrique, November-December 1991, vol. 71, no. 6, pages 36-42.

[2] <<Flat panel displays based on surface-conduction electron emitters>>, K. Sakai et al., Proceedings on the 16$^{th}$ International Display Research Conference, ref. 18.3L., pages 569-572.

[3] <<Carbon nanotube FED elements>>, S. Uemura et al. Digest, pages 1052-1055.
[4] <<Microtips addressing>>, T. Leroux et al. SID1991 Digest, pages 437-439.
[5] EP-A-0 635 819.
[6] FR-A-2 832 537.
[7] EP-A-0 597 772.
[8] EP-A-0 316 214.
[9] <<6-in Video CNT-FED with improved uniformity>> J. Dijon et al. IDW 2005, pages 1-4.

The invention claimed is:

1. A method to drive a matrix display device capable of displaying grey levels at one or more electron sources, including one or more row electrodes and one or more column electrodes, the electron source being defined at an intersection of a row electrode and a column electrode, the method comprising:

for a row selection period, a row select potential is applied to a selected row electrode, during the period a voltage is simultaneously applied to a column electrode, the voltage depending on the grey level to be displayed by the electron source at the intersection of the selected row electrode and the column electrode, wherein the grey levels to be displayed are divided into only first and second grey level families irrespective of a number of grey levels, the first grey level family grouping together a plurality of darkest grey levels, the second grey level family grouping together a plurality of least dark grey levels;

for each of the grey levels to be displayed by the electron source that belong to the first family, the voltage of the column electrode, right at the start of the row selection period, is brought from an intermediate potential, lying between a second potential used to display black and a first potential used to display white, to the second potential irrespective of the grey level to be displayed and it is then returned to the intermediate potential after a time equal to or less than the row selection period and which depends on the grey level to be displayed;

for each of the grey levels to be displayed that belong to the second family, the voltage of the column electrode is brought from the intermediate potential to the first potential at an instant in the row selection period which depends on the grey level to be displayed, and it is returned to the intermediate potential at the end of the row selection period irrespective of the grey level to be displayed;

and wherein, after the row selection period, the row electrode which was selected is brought to a discharge potential and it is then set at high impedance.

2. A driving method according to claim 1, wherein further, for one of the grey levels of one of the families, the voltage of the column electrode is held at the intermediate potential throughout the entire row selection period.

3. A driving method according to claim 1, wherein the row select voltage is constant during the row selection period.

4. A driving method according to claim 1, wherein if plural electron sources are on one same row electrode, a voltage is applied simultaneously to each of the column electrodes.

5. A driving method according to claim 1, wherein the first potential is substantially 0 volt.

6. A driving method according to claim 1, wherein the intermediate potential lies substantially midway between the first potential and the second potential.

7. A driving method according to claim 1, wherein the second potential is positive compared with the first potential.

8. A driving method according to claim 1, wherein the application times of the first potential during the row selection period and the application times of the second potential during the row selection period are distributed non-linearly.

9. A driving method according to claim 8, wherein the application times (ti) of the first potential or of the second potential verify the equation $ti=Tl[1-(i/r)^{2,2}]$ in which r is the number of grey levels in the grey level family for which switching occurs and i is a variant from 1 to r.

10. A driving device to drive a matrix display device displaying grey level, including one or more electron sources each positioned at an intersection of a row electrode and a column electrode of an assembly comprising one or more row electrodes and one or more column electrodes, the driving device comprising:

a line scan generator which, when the row electrode on which the electron source lies is selected, applies a row select potential during a row selection period; and a column drive circuit configured to apply, to the corresponding column electrode, a voltage corresponding to the grey level to be displayed, during the row selection period, wherein all the grey levels to be displayed are distributed in only first and second grey level families irrespective of a number of grey levels, the first grey level family including a plurality of darkest grey levels, and the second grey level family including a plurality of least dark grey levels, wherein the column drive circuit, for each column electrode of the assembly, comprises a first processing chain to deliver a pulse width modulated drive voltage whose pulse starts at the start of the row selection period, between an intermediate potential and a second potential used to display black, to be applied to the column electrode for each of the grey levels to be displayed in the first grey level family, and a second processing chain to deliver a pulse width modulated drive voltage whose pulse ends at the end of the row selection period, between the intermediate potential and a first potential, to be applied to the column electrode for each of the grey levels to be displayed, wherein the line scan generator, after the row selection period, bringing the row electrode which was selected, but is no longer selected, to a discharge potential then setting it at high impedance.

11. A device according to claim 10, wherein the first processing chain, on the basis of information it receives encoding the grey levels to be displayed, delivers a signal which translates an end-of-pulse instant of the pulse width modulated voltage in the row selection period, and the second processing chain delivers a signal which translates a start-of-pulse instant of the pulse width modulated voltage in the row selection period, the first and second processing chains being connected via selecting means to an output stage capable of delivering the voltage to be applied to the column electrode.

12. A device according to claim 10, wherein the first processing chain comprises a comparator comparing the information encoding the grey levels and the result of counting performed by a cyclic counter counting a number of clock pulses determined by the size of the data item encoding the grey levels, during the row selection period, and a bistable latch connected to the output of the comparator and also receiving a pulse at the start of each row selection period and delivering the signal translating the end-of-pulse instant of the pulse width modulated voltage.

13. A driving device according to claim 10, wherein the second processing chain comprises a comparator comparing the information encoding the grey levels and the result of counting performed by a cyclic counter counting a number of clock pulses determined by the size of the data item encoding the grey levels, during the row selection period, and a bistable latch connected to the output of the comparator and also receiving a pulse at the end of each row selection period and delivering the signal translating the start-of-pulse instant of the pulse width modulated voltage.

14. A driving device according to claim 12, wherein the cyclic counter is common to the first and second processing chains.

15. A device according to claim 11, wherein the grey levels to be displayed are encoded in the form of a binary word with one or more most significant bits, the selecting means including combinatorial logic circuits receiving the most significant bits of the binary word.

16. A device according to claim 10, wherein the column drive circuit further comprises a shift register that supplies as many sets of latches as there are column electrodes, each set of latches receiving at its input the grey levels to be displayed by the display device and being connected to a first processing chain and to a second processing chain.

* * * * *